US012644222B2

(12) United States Patent
Park et al.

(10) Patent No.: US 12,644,222 B2
(45) Date of Patent: Jun. 2, 2026

(54) CLOTHES DRYER

(71) Applicant: SAMSUNG ELECTRONICS CO., LTD., Suwon-si (KR)

(72) Inventors: Junhong Park, Suwon-si (KR); Guangri Jin, Suwon-si (KR); Woojin Kim, Suwon-si (KR); Eungryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 748 days.

(21) Appl. No.: 18/115,105

(22) Filed: Feb. 28, 2023

(65) Prior Publication Data

US 2023/0203742 A1 Jun. 29, 2023

Related U.S. Application Data

(63) Continuation of application No. PCT/KR2021/009227, filed on Jul. 19, 2021.

(30) Foreign Application Priority Data

Sep. 14, 2020 (KR) ..... 10-2020-0117508

(51) Int. Cl.
*D06F 58/02* (2006.01)
*D06F 25/00* (2006.01)
(Continued)

(52) U.S. Cl.
CPC ..... *D06F 58/10* (2013.01); *D06F 58/06* (2013.01); *D06F 58/08* (2013.01); *D06F 58/206* (2013.01); *D06F 58/24* (2013.01)

(58) Field of Classification Search
CPC ..... D06F 58/02; D06F 58/06; D06F 58/08; D06F 58/10; D06F 58/24; D06F 58/38; D06F 58/206; D06F 25/00
(Continued)

(56) References Cited

U.S. PATENT DOCUMENTS 2,975,528 A * 3/1961 Shewmon ..... D06F 58/08 310/67 R
8,104,192 B2 1/2012 Myung et al.
(Continued)

FOREIGN PATENT DOCUMENTS

CN 101151410 A 3/2008
CN 104631070 A 5/2015
(Continued)

OTHER PUBLICATIONS

European Office Action dated Apr. 18, 2024 for European Application No. 21866982.8.
(Continued)

*Primary Examiner* — Deming Wan
(74) *Attorney, Agent, or Firm* — STAAS & HALSEY LLP

(57) ABSTRACT

A clothes dryer including a cabinet including an inlet and a base; a drum inside the cabinet, a support frame including a front support frame supporting a front end portion of the drum, and having a laundry inlet, and a rear support frame supporting a rear end portion of the drum; a blow fan below the front support frame; and a guide portion behind the blow fan, and connected with the blow fan. The blow fan and the guide portion may be configured so that the blow fan is operable to move outside air to inside of the cabinet, and the guide portion guides a first portion of the outside air moved inside of the cabinet by the blow fan toward a gap between the drum and the front support frame to dry air leaking from between the drum and the front support frame.

15 Claims, 12 Drawing Sheets

(51) Int. Cl.

| | |
|---|---|
| ***D06F 58/06*** | (2006.01) |
| ***D06F 58/08*** | (2006.01) |
| ***D06F 58/10*** | (2006.01) |
| ***D06F 58/20*** | (2006.01) |
| ***D06F 58/24*** | (2006.01) |
| ***D06F 58/38*** | (2020.01) |

(58) Field of Classification Search
USPC ..... 34/378, 395, 601, 610, 477
See application file for complete search history.

(56) References Cited

U.S. PATENT DOCUMENTS

| | | | |
|---|---|---|---|
| 9,845,566 | B2 | 12/2017 | Heo et al. |
| 10,100,460 | B2 | 10/2018 | Bisaro et al. |
| 10,526,746 | B2 | 1/2020 | Kitayama et al. |
| 10,590,592 | B2 | 3/2020 | Lee et al. |
| 10,662,575 | B2 | 5/2020 | Ahn et al. |
| 2005/0132600 | A1 | 6/2005 | Myung |
| 2009/0071030 | A1 | 3/2009 | Myung et al. |
| 2014/0060092 | A1 | 3/2014 | Pillot et al. |
| 2014/0082960 | A1* | 3/2014 | Bison ..... F25B 49/02 34/477 |
| 2017/0314181 | A1 | 11/2017 | Wakizaka et al. |
| 2021/0187559 | A1 | 6/2021 | Kim et al. |
| 2021/0230788 | A1 | 7/2021 | Lee et al. |

FOREIGN PATENT DOCUMENTS

| | | |
|---|---|---|
| EP | 2 077 350 B1 | 7/2011 |
| EP | 2 733 255 A1 | 5/2014 |
| EP | 2 840 181 A1 | 2/2015 |
| EP | 3 333 306 | 10/2019 |
| EP | 3 426 838 B1 | 12/2019 |
| EP | 3 792 390 | 3/2021 |
| JP | 2004-215943 | 8/2004 |
| JP | 2008-48810 | 3/2008 |
| JP | 2014-30473 | 2/2014 |
| KR | 10-0638905 | 10/2006 |
| KR | 10-0861831 | 10/2008 |
| KR | 10-1021710 | 3/2011 |
| KR | 10-1093865 | 12/2011 |
| KR | 10-2014-0065267 | 5/2014 |
| KR | 10-2014-0129819 | 11/2014 |
| KR | 10-2016-0136197 | 11/2016 |
| KR | 10-1712908 | 3/2017 |
| KR | 10-1718042 | 4/2017 |
| KR | 10-2019-0102821 A | 9/2019 |
| KR | 10-2019-0128484 | 11/2019 |
| KR | 10-2019-0128491 | 11/2019 |
| KR | 10-2019-0128493 | 11/2019 |
| KR | 10-2019-0128529 | 11/2019 |

OTHER PUBLICATIONS

International Search Report, PCT/ISA/210, dated Nov. 9, 2021, in International Application No. PCT/KR2021/009227.

Korean Office Action dated Jul. 19, 2025 for Korean Application No. 10-2020-0117508.

Extended European Search Report dated Oct. 25, 2023 for European Application No. 21866982.8.

* cited by examiner

CLOTHES DRYER

CROSS-REFERENCE TO RELATED APPLICATIONS

This application is a continuation application under 35 U.S.C. § 111(a) of international Application No. PCT/KR2021/009227, filed on Jul. 19, 2021, which claims priority to Korean Patent Application No. 10-2020-0117508, filed on Sep. 14, 2020, the disclosures of which are incorporated by reference herein in their entireties.

BACKGROUND

1. Field

The present disclosure relates to a clothes dryer, and more particularly, to a clothes dryer having a structure for reducing condensation of moist air.

2. Description of the Related Art

A dryer evaporates water included in an object to be processed, such as clothes or bed clothes, put in the drum (or tub) by supplying hot air to the object. Air evaporated water of the object to be processed in the drum and then discharged from the drum is in a hot and humid state because the air holds the water of the object to be processed. According to methods of processing such hot and humid air, dryers are classified into a condensing type and an exhaust type.

The condensing type dryer condenses water included in hot and humid air through heat exchange by circulating the air without discharging the air to the outside. In contrast, the exhaust type dryer discharges hot and humid air directly to the outside. There is a structural difference in that the condensing type dryer has a structure for processing condensed water and the exhaust type dryer has a structure for exhausting air.

Particularly, in the condensing type dryer, hot and humid air may leak out of the drum because the air is not discharged to the outside. The hot and humid air leaking out of the drum causes dew condensation inside the dryer.

SUMMARY

Aspects of embodiments of the disclosure will be set forth in part in the description which follows and, in part, will be apparent from the description, or may be learned by practice of the presented embodiments.

According to an embodiment of the disclosure, a clothes dryer may include a cabinet including an inlet and a base; a drum rotatably provided inside the cabinet, the drum including a front end portion and a rear end portion; a support frame including a front support frame supporting the front end portion of the drum, and having a laundry inlet, wherein the inlet of the cabinet, the laundry inlet, and the front end portion of the drum are positioned so that laundry is insertable through the inlet of the cabinet and then through the laundry inlet to be received in the drum, and a rear support frame supporting the rear end portion of the drum; a blow fan below the front support frame; and a guide portion behind the blow fan, and connected with the blow fan. The blow fan and the guide portion may be configured so that the blow fan is operable to move outside air to inside of the cabinet, and the guide portion guides a first portion of the outside air moved inside of the cabinet by the blow fan toward a gap between the drum and the front support frame to dry air leaking from between the drum and the front support frame.

According to an embodiment of the disclosure, the clothes dryer further includes a Printed Board Assembly (PBA) configured to drive various loads for overall operations of the clothes dryer, wherein the guide portion guides a second portion of the outside air moved inside of the cabinet by the blow fan to the PBA to cool the PBA.

According to an embodiment of the disclosure, the guide portion includes a first guide portion configured to guide the first portion of the outside air moved inside of the cabinet by the blow fan toward the gap between the drum and the front support frame, and a second guide portion connected with the first guide portion, and configured to guide the second portion of the outside air moved inside of the cabinet by the blow fan to the PBA.

According to an embodiment of the disclosure, the first guide portion and the second guide portion are integrated into one body.

According to an embodiment of the disclosure, the first guide portion extends toward the gap between the drum and the front support frame.

According to an embodiment of the disclosure, the first guide portion includes a first passage through which the first portion of the outside air moves, and a first outlet connected with the first passage and configured to discharge the first portion of the outside air, and the second guide portion includes a second passage through which the second portion of the outside air moves, and a second outlet connected with the second passage and configured to discharge the second portion of the outside air.

According to an embodiment of the disclosure, the clothes dryer further includes a blow fan case below the front support frame and accommodating the blow fan, wherein the guide portion is coupled with the blow fan case.

According to an embodiment of the disclosure, a coupling hole is in one side of the blow fan case, and the guide portion includes a coupling member coupled with the coupling hole.

According to an embodiment of the disclosure, the clothes dryer further includes a forced convection device on the base of the cabinet and configured to circulate air between the drum and the cabinet.

According to an embodiment of the disclosure, the forced convection device moves at least a portion of the air leaking from between the drum and the front support frame toward the rear support frame.

According to an embodiment of the disclosure, the clothes dryer further includes a driver configured to transfer power to the drum; a compressor; an expansion valve; an evaporator; and a condenser, wherein the base includes a first area on which the driver, the compressor, and the expansion valve are positioned, a second area on which the evaporator and the condenser are positioned, the second area forming a lower temperature than a temperature of the first area, and the forced convection device is provided on the second area.

According to an embodiment of the disclosure, the guide portion is adjacent to one of a left plate and a right plate of the cabinet, and the forced convection device is adjacent to a remaining one of the left plate and the right plate of the cabinet.

According to an embodiment of the disclosure, the forced convection device includes a convection fan configured to dissipate the air by rotating; and a convection fan case accommodating the convection fan.

According to an embodiment of the disclosure, the clothes dryer further includes a duct connected with the drum and configured to circulate air through the drum, the duct including a hot air discharging duct connected to discharge air from inside of the drum, a connecting duct connected with the hot air discharging duct and accommodating an evaporator and a condenser to treat air passing through the connecting duct, and a hot air guide duct connected with the connecting duct and configured to supply air passed through the connecting duct to the drum, wherein the forced convection device is provided on an outer surface of the connecting duct.

According to an embodiment of the disclosure, the clothes dryer further includes a sealing member coupled with a front surface of the drum and configured to form a seal between the drum and the front support frame, wherein the forced convection device is located behind the sealing member, and configured to circulate at least a portion of the air leaking from between the sealing member and the front support frame.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
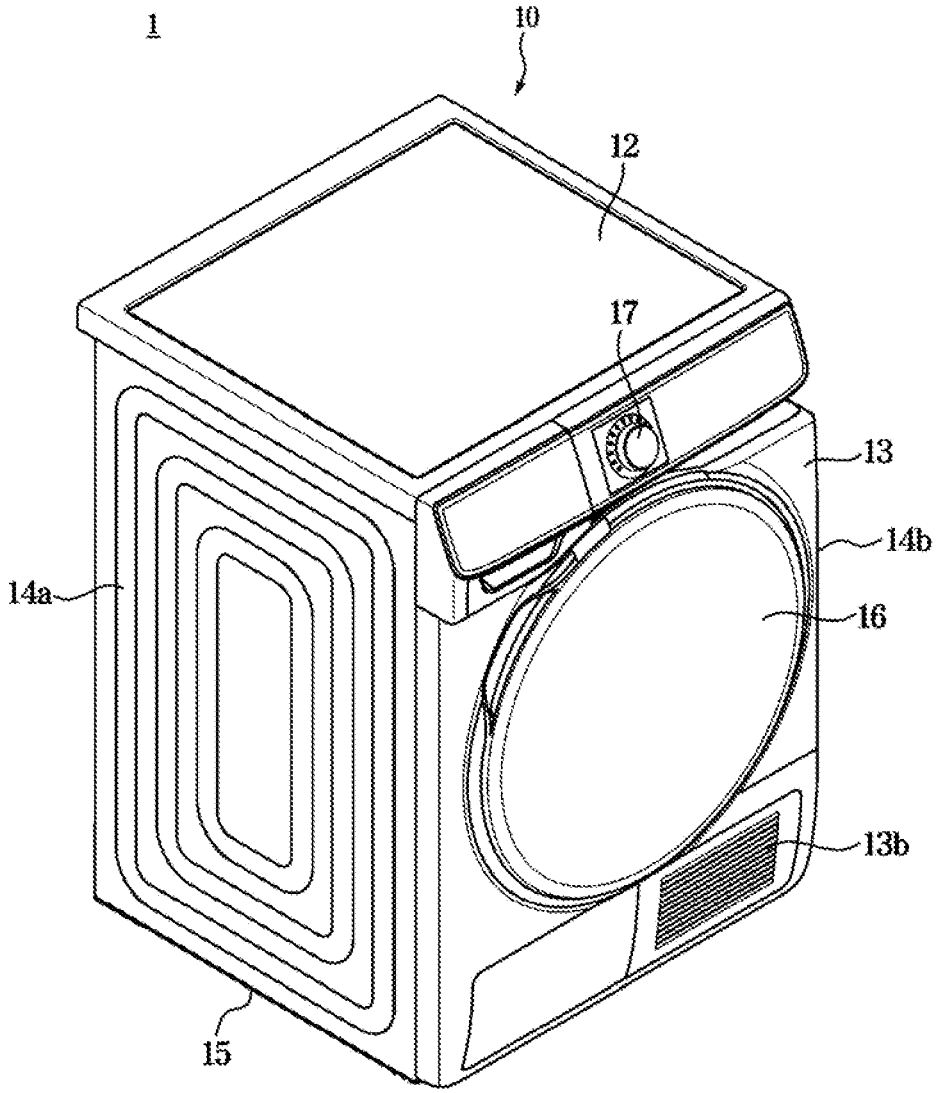
FIG. 1 is a perspective view showing an appearance of a clothes dryer according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Embodiments of the disclosure may provide a clothes dryer capable of lowering relative humidity of moist air leaking between an outer side of a drum and a front support frame.

Embodiments of the disclosure may provide a clothes dryer capable of reducing condensation of moist air on a front support frame by causing forced convection on an inner side of the front support frame.

According to embodiments of the disclosure, moist air leaking between a drum and a front support frame may be prevented from being condensed on an inner side of the frame. Also, ambient temperature of the drum may be prevented from being reduced by outside air, and, accordingly, performance deterioration of the dryer may be prevented. Also, because inside moist air is not discharged to the outside, dew condensation and mold growth inside a laundry room may be not accelerated.

According to an embodiment of the disclosure, a clothes dryer may include a cabinet including an inlet and a base; a drum rotatably provided inside the cabinet; a duct connected with the drum and configured to circulate air, the duct including a hot air discharging duct connected to discharge inside air of the drum, a connecting duct connected with the hot air discharging duct and accommodating an evaporator and a condenser, and a hot air guide duct connected with the connecting duct and configured to again supply air passed through the connecting duct to the drum; and a forced convection device provided on an outer surface of the connecting duct and configured to circulate air leaking between the drum and the cabinet. The clothes dryer may further include a support frame including a front support frame including a laundry inlet corresponding to the inlet and rotatably supporting a front end portion of the drum, and a rear support frame rotatably supporting a rear end portion of the drum, and the forced convection device may move air leaking between the drum and the front support frame toward the rear support frame. The base may include a first area on which a driver configured to transfer power to the drum, a compressor, and an expansion valve are positioned; and a second area on which an evaporator and a condenser are positioned, the second area forming lower temperature than temperature of the first area, and the forced convection device may be provided on the second area. The forced convection device may be provided at an edge of the connecting duct. The forced convection device may include: a convection fan configured to dissipate the air by rotating; and a convection fan case accommodating the convection fan.

Hereinafter, an embodiment of the disclosure will be described in detail with reference to the accompanying drawings.

Figure 2:
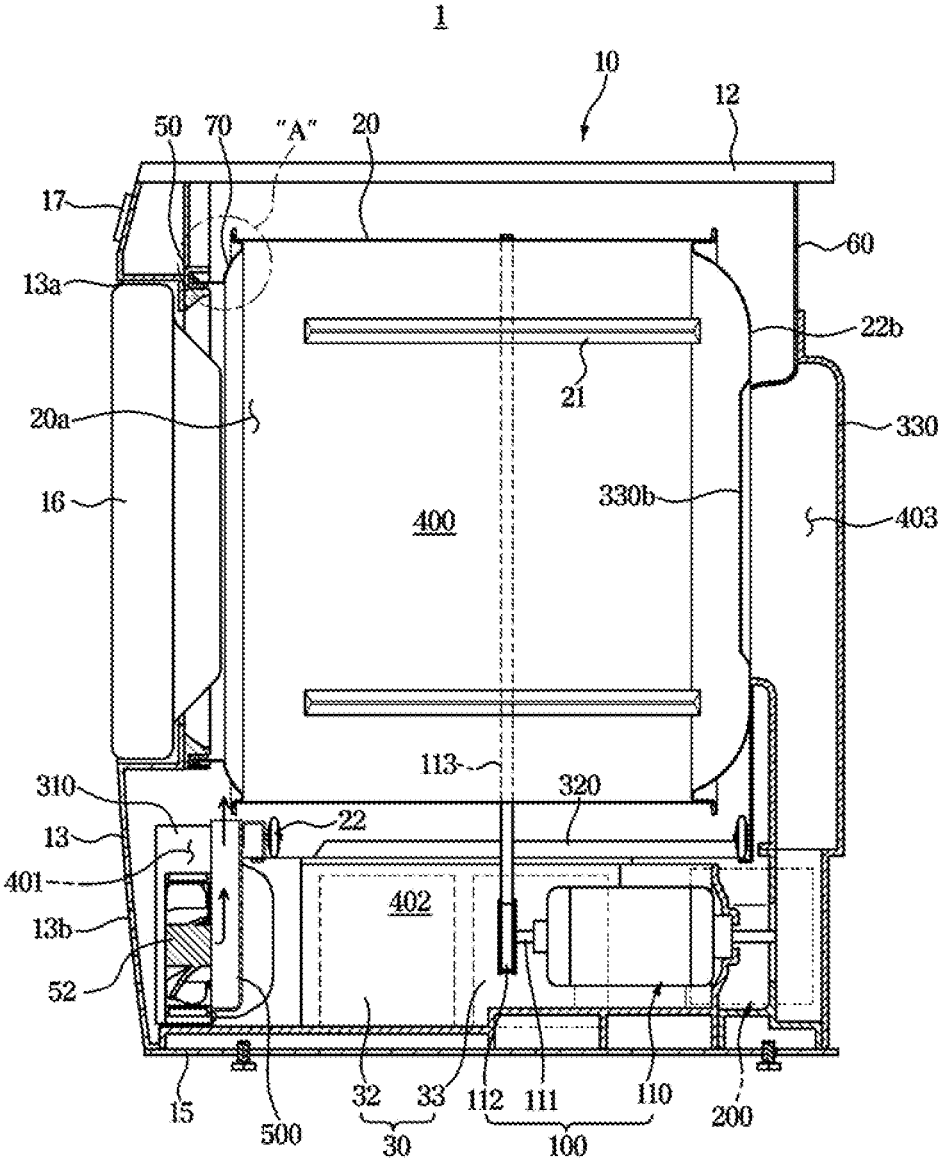
FIG. 2 is a cross-sectional view showing the clothes dryer of FIG. 1 according to an embodiment of the disclosure.
Figure 3:
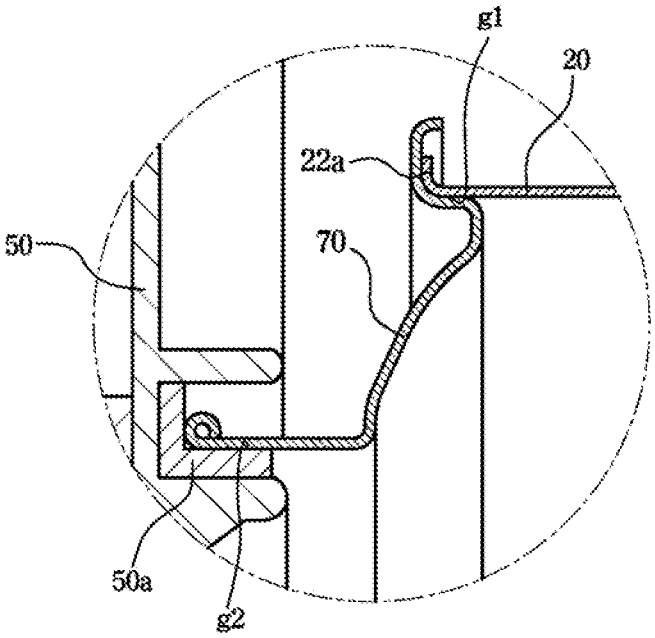
FIG. 3 is an enlarged view showing 'A' of FIG. 2 according to an embodiment of the disclosure.
Figure 4:
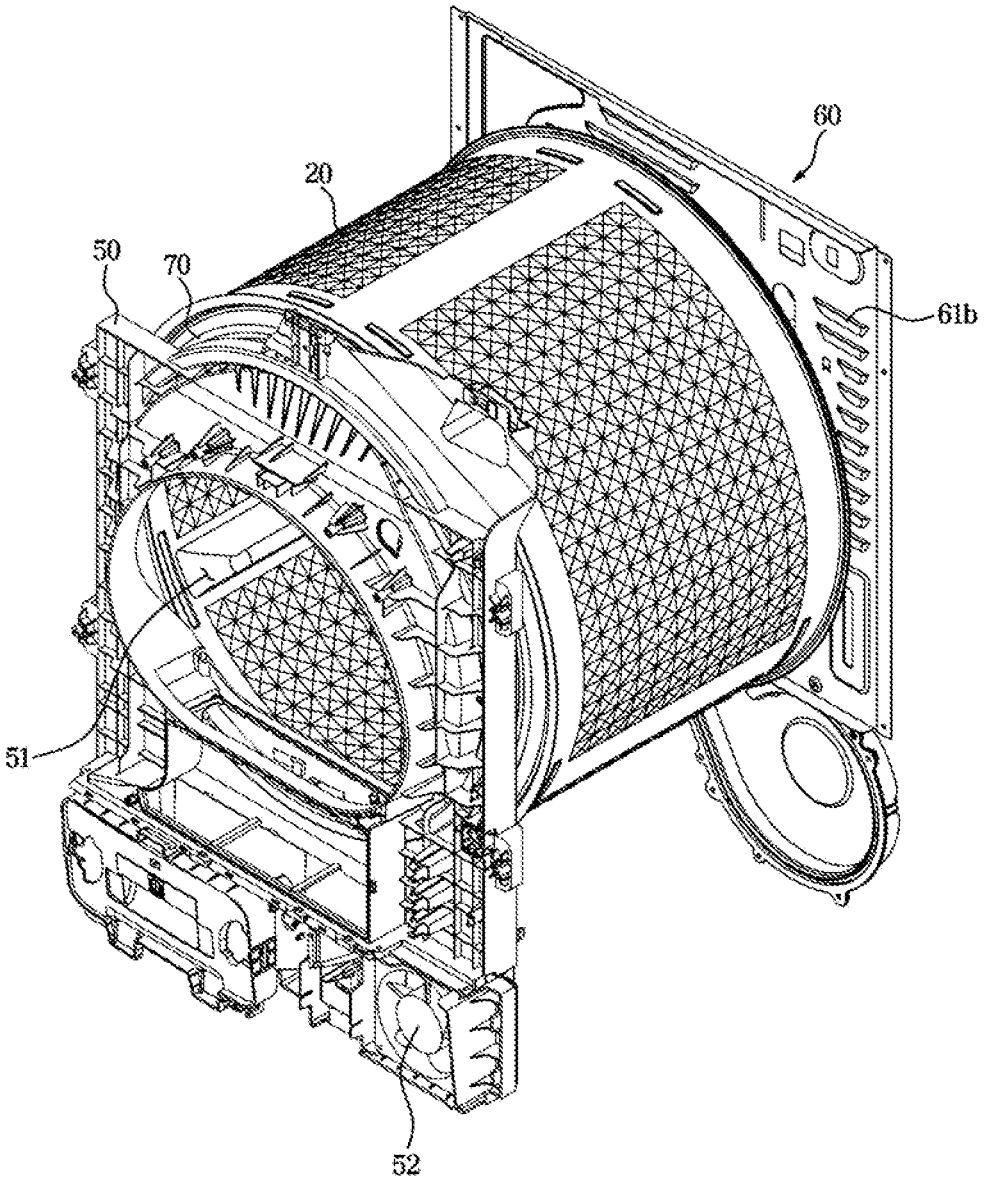
FIG. 4 shows a coupled state of a front support frame, a blow fan, a guide portion, a sealing member, a drum, and a rear support frame in a clothes dryer according to an embodiment of the disclosure.
Figure 5:
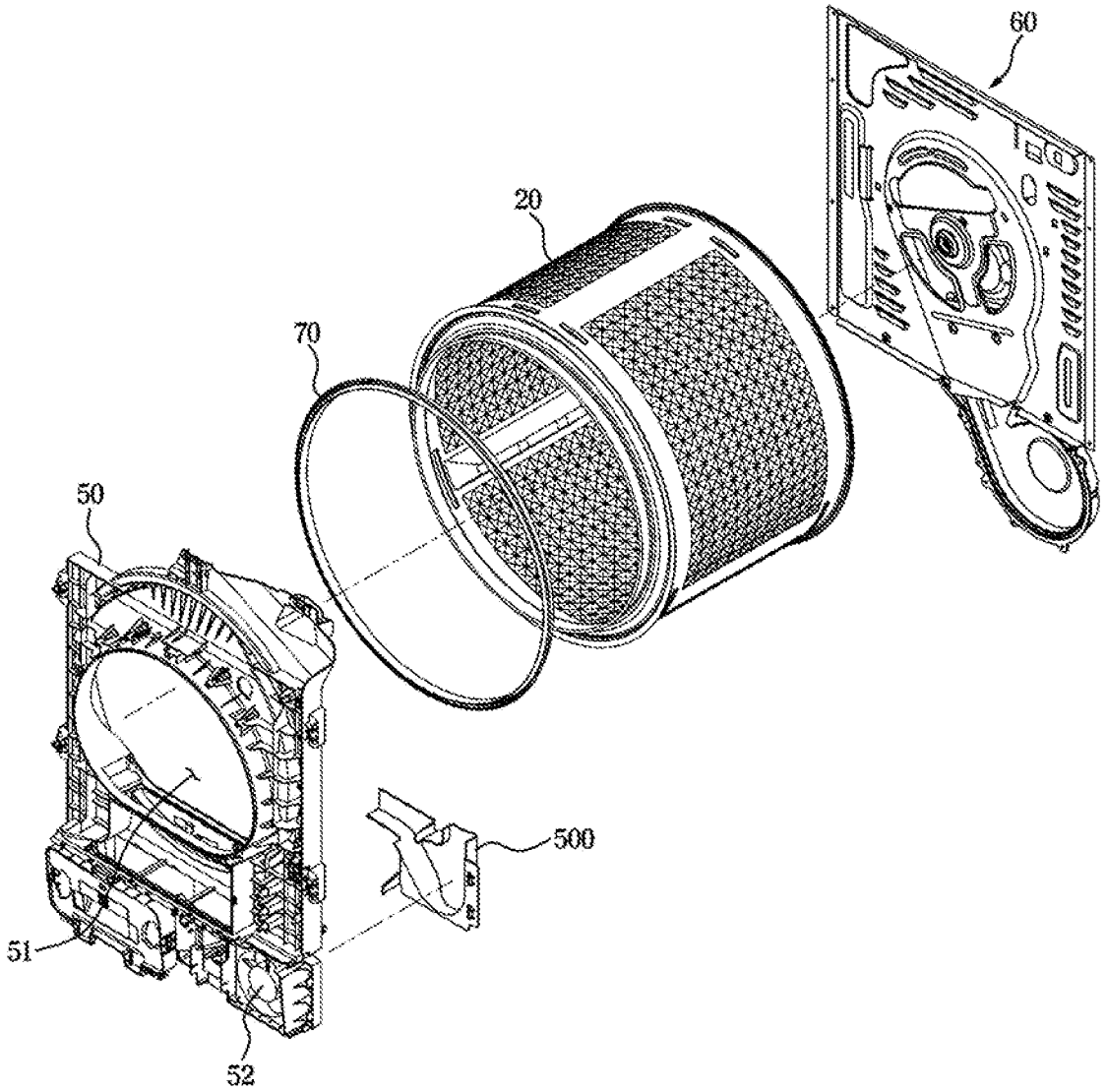
FIG. 5 is an exploded perspective view of a front support frame, a blow fan, a guide portion, a sealing member, a drum, and a rear support frame in a clothes dryer according to an embodiment of the disclosure.

FIG. 1 is a perspective view showing an appearance of a clothes dryer according to an embodiment of the disclosure, FIG. 2 is a cross-sectional view showing the clothes dryer of FIG. 1, FIG. 3 is an enlarged view showing 'A' of FIG. 2, FIG. 4 shows a coupled state of a front support frame, a blow fan, a guide portion, a sealing member, a drum, and a rear support frame in a clothes dryer according to an embodiment of the disclosure, and FIG. 5 is an exploded perspective view of a front support frame, a blow fan, a guide portion, a sealing member, a drum, and a rear support frame in a clothes dryer according to an embodiment of the disclosure.

Referring to FIGS. 1 to 5, a clothes dryer 1 may include a cabinet 10 forming an appearance, and a drum 20 rotatably installed inside the cabinet 10.

The cabinet 10 may be substantially in a shape of a hexahedron (box). More specifically, the cabinet 10 may include a rear plate, an upper plate 12, a front plate 13, a left plate 14*a*, a right plate 14*b*, and a base 15. An embodiment of the disclosure shows an example in which the front plate, the upper plate, the base, etc., forming the cabinet 10 are prepared separately and then assembled together. However, a concept of the disclosure is not limited to this. For example, at least one part of the cabinet, the front plate, the upper plate, the base, etc., may be integrated into one body.

In the front plate 13 of the cabinet 10, an inlet 13*a* through which clothes (not shown) as an object to be dried are put into or taken out of the drum 20 may be formed. The inlet 13*a* may be opened or closed by a door 16. On an upper portion of the cabinet 10, a control panel 17 for controlling operations of the clothes dryer 1 may be provided.

A laundry inlet 51 which will be described below may be formed in a front support frame 50 to correspond to the inlet 13*a*. That is, the laundry inlet 51 which will be described below may be formed in the front support frame 50 to communicate with the inlet 13*a*.

In one side of a lower portion of the front plate 13 of the cabinet 10, a plurality of holes 13*b* may be formed. The plurality of holes 13*b* may allow outside air to enter inside of the cabinet 10. In at least one portion of a rear support frame 60 of the cabinet 10, a plurality of holes 61*b* may be formed.

Inside the cabinet 10, a blow fan 52 which will be described below may be positioned. Outside air entered the inside of the cabinet 10 by the blow fan 52 may flow by the blow fan 52 and be discharged to outside of the cabinet 10 through the plurality of holes 61*b* formed in the rear support frame 60 of the cabinet 10.

Outside air may enter the inside of the cabinet 10 through the plurality of holes 13*b* formed in the front plate 13 of the cabinet 10 and flow by the blow fan 52.

The blow fan 52 may be positioned in a front lower space of the cabinet 10. The blow fan 52 may be positioned to correspond to the plurality of holes 13*b* formed in the front plate 13 of the cabinet 10.

Inside the cabinet 10, the drum 20 being in a shape of a cylinder may be provided. In a front end portion 22*a* of the drum 20, an opening 20*a* corresponding to the inlet 13 formed in the front plate 13 may be formed. An object to be dried may be put into the drum 20 or taken out of the drum 20 through the opening 20*a*.

The drum 20 may be provided inside the cabinet 10 in such a way as to be rotatable with respect to a rotating axis. On an inner circumferential surface of the drum 20, a lifter 21 for lifting an object to be dried while the drum 20 rotates may be provided. While the drum 20 rotates, an operation of lifting the object to be dried by the lifter 21 and dropping the object to be dried may be repeatedly performed. On an outer circumferential surface of the drum 20, a roller 22 supporting the drum 20 to enable the drum 20 to smoothly rotate may be provided.

The drum 20 may be rotatable by receiving power from a driver 100. The driver 100 may be positioned in an inner lower space of the cabinet 10. The driver 100 may be mounted on the base 15. The driver 100 may include a motor 110, and a pulley 112 and a belt 113 for transferring power of the motor 110 to the drum 20. The pulley 112 may be connected with a rotating shaft 111 connected with the motor 110. According to a rotation of the rotating shaft 111 by the motor 10, the pulley 112 may also rotate together with the rotating shaft 111. The belt 113 may be wound around an outer surface of the pulley 112 and an outer surface of the drum 20. According to a rotation of the belt 113 by a driving force of the motor 110, the drum 20 may rotate together with the belt 113.

The clothes dryer 1 may further include support frames 50 and 60 that support the drum 20. The support frames 50 and 60 may be positioned between the cabinet 10 and the drum 20. The support frames 50 and 60 may include a front support frame 50 that rotatably supports the front end portion 22*a* of the drum 20, and a rear support frame 60 that rotatably supports a rear end portion 22*b* of the drum 20. The front support frame 50 may be fixed on the front plate 13 of the cabinet 10 and positioned between the front plate 13 of the cabinet 13 and the front end portion 22*a* of the drum 20.

In the front support frame 50, the laundry inlet 51 may be formed. An object to be dried may be put into the drum 20 through the laundry inlet 51. The rear support frame 60 may be connected with a hot air guide duct 330 which will be described below, and hot and dry air capable of drying an object to be dried may enter the inside of the drum 20 through a second guide hole 330*b* of the hot air guide duct 330.

The clothes dryer 1 may further include a sealing member 70 positioned between the drum 20 and the front support frame 50 to maintain airtightness between the drum 20 and the front support frame 50.

The front support frame 50 may include a sealing member installing portion 50*a* in which the sealing member 70 is installed. The sealing member 70 may be installed in the sealing member installing portion 50*a*. The front end portion 22*a* of the drum 20 may be in contact with the sealing member 70 and supported by the sealing member 70.

The sealing member 70 may seal between the front end portion 22*a* of the drum 20 and the sealing member installing portion 50*a* of the front support frame 50.

Insufficient sealing between the drum 20 and the front support frame 50 may cause leakage of lint or a steam that may be generated during drying of an object to be dried through a gap between the drum 20 and the front support frame 50. The lint or steam may deteriorate drying performance of the clothes dryer 1 and also cause a safety accident such as a fire. Accordingly, it may be significantly important to secure airtightness between the drum 20 and the front support frame 50 by using the sealing member 70.

The sealing member 70 may function to reduce frictional resistance between the drum 20 and the front support frame 50, as well as maintaining airtightness between the drum 20 and the front support frame 50.

The sealing member 70 may be in a shape of a closed loop. For example, the sealing member 70 may be in a shape of a ring.

The drum 20 may accommodate an object to be dried therein to dry the object to be dried. In the cabinet 10, a duct 300 for forming a flow path 400 for circulating dry air to the drum 20 may be provided.

The duct 300 may include a hot air discharging duct 310 forming a discharging flow path 401 for discharging hot air passed through the inside of the drum 20, a hot air guide duct 330 forming a guide flow path 403 for guiding hot air to the drum 20, and a connecting duct 320 forming a connecting flow path 402 and connecting the hot air discharging duct 310 with the hot air guide duct 330.

The flow path 400 may include the discharging flow path 401, the connecting flow path 402, and the guide flow path 403.

The connecting flow path 402 may accommodate an evaporator 32 and a condenser 33 of a heat pump 30.

The hot air discharging duct 310 may be positioned below the front surface of the drum 20. The hot air guide duct 330 may be positioned behind the drum 20. The connecting duct 320 may be positioned below the drum 20. The connecting duct 320 may be installed on the base 15.

Hot and dry air may be supplied to the inside of the drum 20 by the hot air guide duct 330, and an object to be dried inside the drum 20 may be dried by the hot and dry air. After drying the object to be dried, the air may be in a hot and humid state, and the hot and humid air in the drum 20 may be discharged to outside of the drum 20 through the hot air discharging duct 310.

Figure 6:
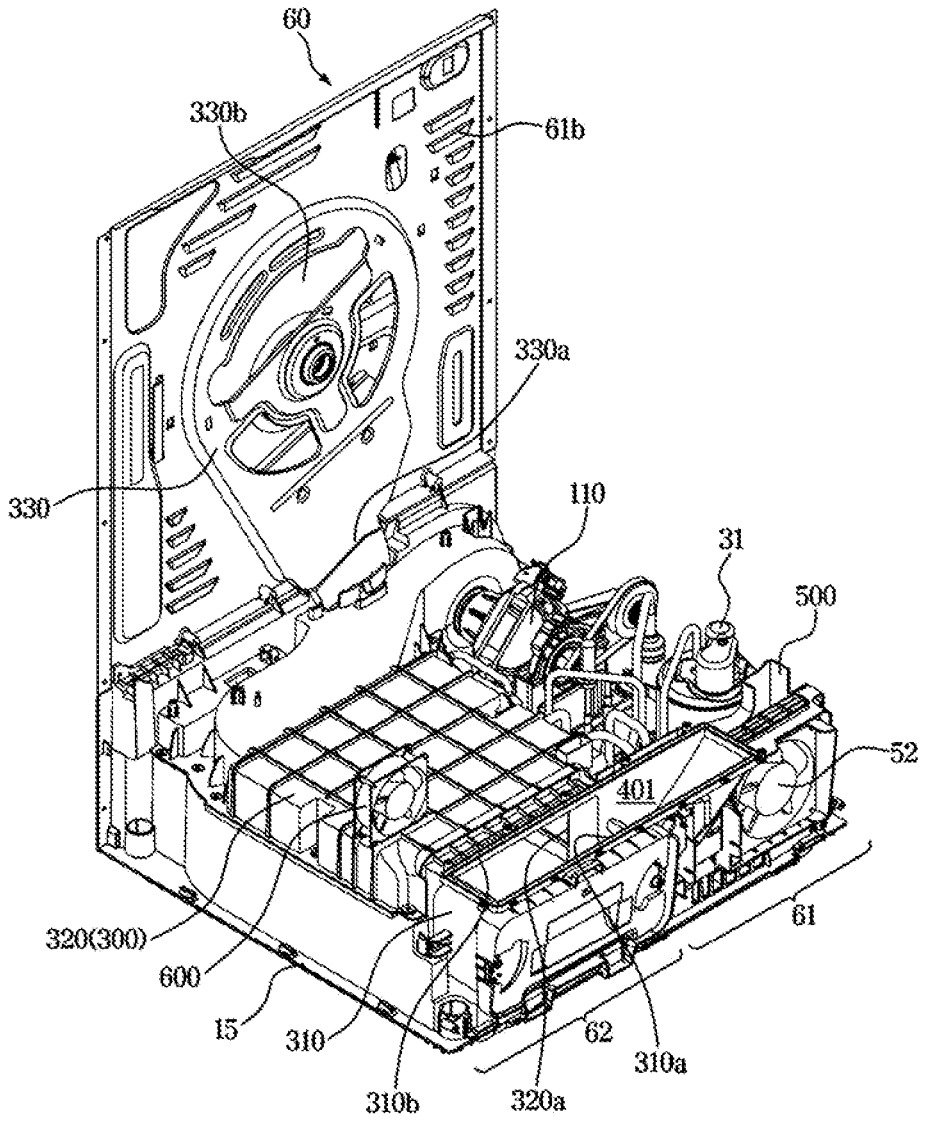
FIG. 6 is a perspective view showing a guide portion, a duct, and a heat pump installed on a base and a rear support frame according to an embodiment of the disclosure.
Figure 7:
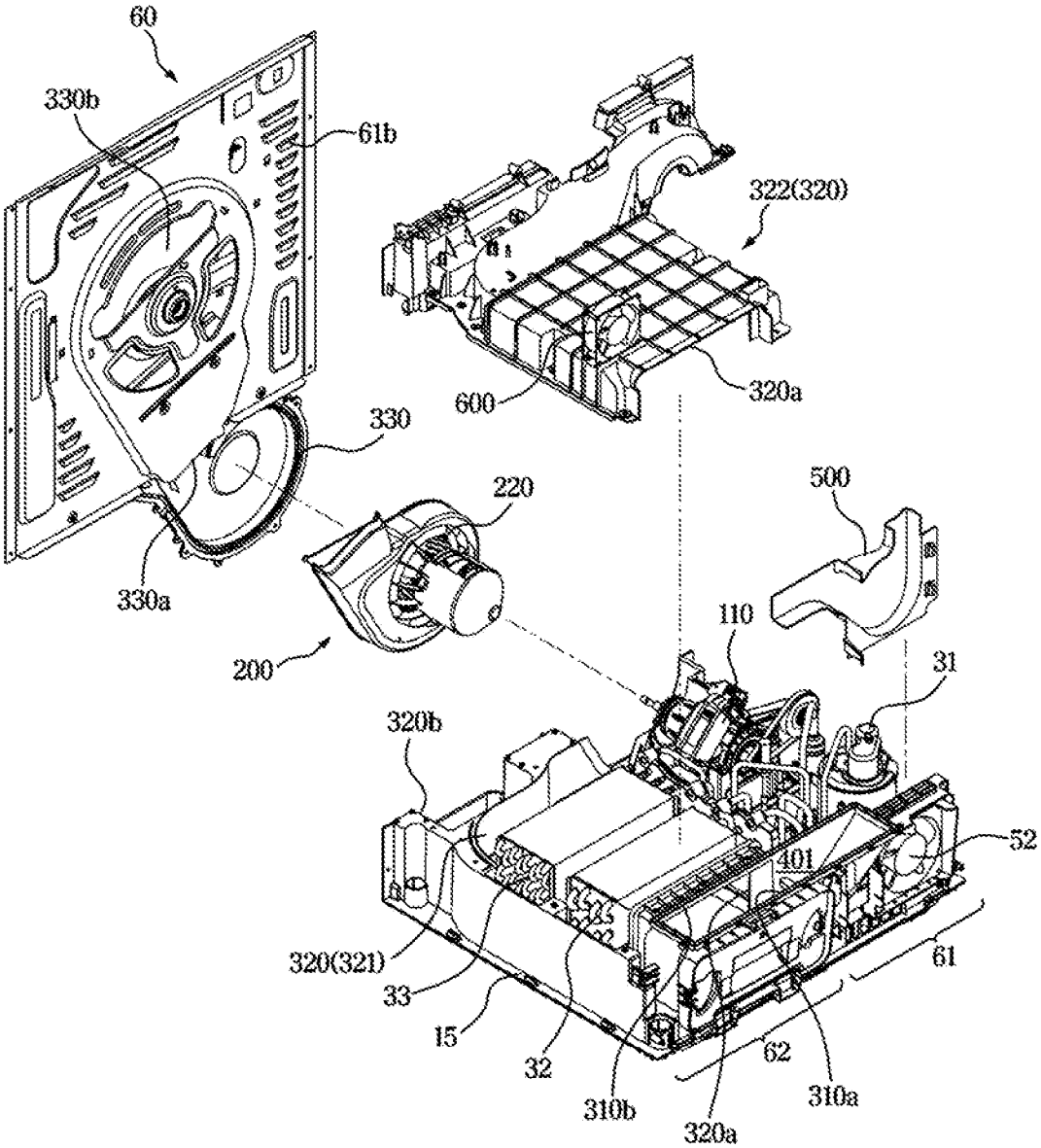
FIG. 7 is an exploded perspective view of a guide portion, a duct, and a heat pump installed on a base and a rear support frame according to an embodiment of the disclosure.

FIG. 6 is a perspective view showing a guide portion, a duct, and a heat pump installed on a base and a rear support frame according to an embodiment of the disclosure, and FIG. 7 is an exploded perspective view of a guide portion, a duct, and a heat pump installed on a base and a rear support frame according to an embodiment of the disclosure.

Referring to FIGS. 6 and 7, the hot air discharging duct 310 may include a first hole 310*a* through which hot air of the drum 20 is introduced, and a second hole 310*b* for discharging the air introduced through the first hole 310*a* to the connecting duct 320.

In the hot air discharging duct 310, a filter may be installed to filter foreign materials such as lint included in hot air passed through the drum 20. The air drying the object to be dried inside the drum 20 may be discharged through the hot air discharging duct 310. The air discharged from the hot air discharging duct 310 may enter the connecting duct 320.

The hot and humid air entered the connecting duct 320 through the hot air discharging duct 310 may be guided to the evaporator 32 which will be described below, and thus, water included in the hot and humid air may be removed.

The evaporator 32 may configure the heat pump 30 together with the condenser 33, a compressor 31, and an expansion valve 34 (see FIG. 11), which will be described below. The heat pump 30 may cool hot refrigerant by circulating the refrigerant to remove moist from the air, and then again heat the air.

The heat pump 30 may be mounted on the base 15. The evaporator 32 and the condenser 33 of the heat pump 30 may be positioned on one side of the base 15. The evaporator 32 and the condenser 33 of the heat pump 30 may be positioned inside the duct 300. The evaporator 32 and the condenser 33 of the heat pump 30 may be positioned inside the connecting duct 320. The evaporator 32 and the condenser 33 of the heat pump 30 may be positioned in order in a front-rear direction of the base 15 inside the connecting duct 320.

The hot air discharging duct 310 positioned below a front portion of the drum 20, the connecting duct 320 positioned below the drum 20, and the hot air guide duct 330 positioned behind the drum 20 may be positioned in order in the front-rear direction of the base 15.

The hot air discharging duct 310, the connecting duct 320, and the hot air guide duct 330 may be positioned with a straight line structure in the front-rear direction with respect to the drum 20 to reduce flow resistance. The flow path 400 formed by the hot air discharging duct 310, the connecting duct 320, and the hot air guide duct 330 may be aligned from a front portion to a rear portion of the base 15 to reduce flow resistance of air. More specifically, the connecting flow path 402 may be aligned from the front portion to the rear portion of the base 15 to reduce flow resistance.

A blower 200 for causing air to flow may be provided inside the duct 300. The blower 200 may include a fan 220. The blower 200 may be positioned inside the connecting duct 320. The blower 200 may be positioned behind the connecting duct 320. The blower 200 may be positioned behind the evaporator 32 and the condenser 33. The blower 200 may circulate air inside the flow path 400.

The compressor 31 and the expansion valve 34 of the heat pump 30 may be positioned in the other side of the base 15. The compressor 31 and the expansion valve 34 of the heat pump 30 may be positioned outside the duct 300. The compressor 31 and the expansion valve 34 of the heat pump 30 may be positioned outside the connecting duct 320. The compressor 31 and the expansion valve 34 of the heat pump 30 may be positioned on the same line as the motor 110 in one side of the base 15.

The blow fan 52 may be mounted on the base 15. The blow fan 52 may be positioned at a front portion of one side of the base 15. The blow fan 52 may be positioned on a rear lower side of the front plate 13. The blow fan 52 may receive power from a motor (not shown). The motor may rotate the blow fan 52 to circulate inside air of the cabinet 10. The blow fan 52 may be positioned at a location corresponding to the plurality of holes 13*b* formed in the front plate 13. The blow fan 52 and the motor may be aligned at a location at which the compressor 31, the expansion valve 34, and the motor 110 are positioned. Air entering the inside of the cabinet 10 through the blow fan 52 may cool the inside of the base 15, that is, the compressor 31, the expansion valve 34, and the motor 110, and then be discharged through the plurality of holes 61*b* formed in the rear support frame 60.

Also, a guide portion 500 that communicates with the blow fan 52 to dry air leaking out of the drum 20 by using outside air entered into the inside of the cabinet 10 may be provided on the base 15. The guide portion 500 will be described below.

Meanwhile, the base 15 may include a first area 61 on which the motor 110 is positioned, and a second area 62 except for the first area 61. The first area 61 and the second area 62 may be formed respectively in left and right sides with respect to a center of the base 15. An embodiment of the disclosure shows an example in which the first area is provided in the right side of the base and the second area is provided in the left side of the base. However, a concept of the disclosure is not limited to this.

The first area 61 may be formed in one side of the base 15, and the second area 62 may be formed in the other side of the base 15. On the first area 61 of the base 15, the motor 110 for driving the drum 20 may be positioned. On the first area 61 of the base 15, the blow fan 62, the compressor 31 and the expansion valve 34 of the heat pump 30, and the motor 110 may be positioned.

On the second area 62 of the base 15, the hot air guide duct 330, and the evaporator 32 and the condenser 33 of the heat pump 30 may be positioned.

The connecting duct 320 may be positioned on the second area 62 of the base 15. The hot air discharging duct 310 for discharging hot air passed through the inside of the drum 20 may be positioned in a front portion of the base 15, and extend over the first area 61 and the second area 62 of the base 15. At least a part of the hot air discharging duct 310 may be positioned on the second area 62.

The hot air discharging duct 310 may be biased to the second area 62. The hot air discharging duct 310 may be connected with the connecting duct 320 to communicate with the connecting duct 320.

The connecting duct 320 may include an air inlet (hereinafter, referred to as a first connecting hole) 320*a*, which will be described below, for supplying air passed through the drum 20. The first connecting hole 320*a* of the connecting duct 320 may be positioned in the second area 62 of the base 15. The first connecting hole 320*a* of the connecting duct 320 may be biased from the center C of the base 15.

The connecting duct 320 may include an air outlet (hereinafter, referred to as a second connecting hole) 320*b*, which will be described below, for discharging inside air. The second connecting hole 320*b* may be connected with a first guide hole 330*a* of the hot air guide duct 330 to guide air of the connecting duct 320 to the drum 20 through the hot air guide duct 330. The second connecting hole 320*b* for discharging inside air of the connecting duct 320 may be located in at least a portion of the second area 62. The second connecting hole 320*b* of the connecting duct 320 may be biased from the center C of the base 15. Air entered through the first guide hole 330*a* of the hot air guide duct 330, corresponding to the second connecting hole 320*b* of the connecting duct 320, may be discharged to the drum 20 through the second guide hole 330*b* of the hot air guide duct 330.

Accordingly, in the second area 62 of the base 15, the hot air discharging duct 310 for guiding air discharged from the inside of the drum 20 to the connecting duct 320, the connecting duct 320 for allowing air supplied from the hot air discharging duct 310 to pass through the evaporator 32 and the condenser 33, and the hot air guide duct 330 for again supplying air discharged from the connecting duct 320 to the drum 20 may be positioned in order. The flow path 400 may be simplified by the hot air discharging duct 310, the connecting duct 320, and the hot air guide duct 330 aligned in the second area 62 of the base 15 to reduce flow resistance.

The duct 300 installed in the base 15 may form the flow path 400 for circulating dry air to the drum 20.

The duct 300 may include the hot air discharging duct 310, the connecting duct 320, and the hot air guide duct 330. The hot air discharging duct 310, the connecting duct 320, and the hot air guide duct 330 may form the flow path 400. The flow path 400 may include the discharging flow path 401 formed by the hot air discharging duct 310 for discharging hot air passed through the inside of the drum 20, the connecting flow path 402 connected with the discharging flow path 401 and formed by the connecting duct 320 connecting the hot air discharging duct 310 with the hot air guide duct 330, and the guide flow path 403 connecting the connecting flow path 402 with the drum 20 and formed by the hot air guide duct 330 for guiding hot air to the drum 20.

The discharging flow path 401 may be formed below the front portion of the drum 20. Hot and humid air entered the discharging flow path 401 formed by the hot air discharging duct 310 may enter the connecting flow path 402 by the hot air connecting duct 320. Air of the connecting flow path 402 may be heat-exchanged by the evaporator 32 and the condenser 33 to become hot and dry air, and the hot and dry air may be supplied to the drum 20 through the guide flow path 403 formed by the hot air guide duct 330. The hot air discharging duct 310 may include the first hole 310*a* through which hot air of the drum 20 is introduced, and the second hole 310*b* for discharging the air introduced through the first hole 310*a* is discharged to the connecting duct 320. The second hole 310*b* may be connected with the first connecting hole 320*a* of the connecting duct 320.

In the hot air guide duct 330, the first guide hole 330*a* for introducing hot and dry air of the connecting flow path 402, and the second guide hole 330*b* through which air entered into the hot air guide duct 330 through the first guide hole 330*a* is discharged to the drum 20 may be formed. The second guide hole 330*b* may be connected with the drum 20.

The connecting duct 320 provided between the hot air guide duct 330 and the hot air discharging duct 310 may move hot and humid air passed through the inside of the drum 20 to the evaporator 32.

The evaporator 32 and the condenser 33 may be positioned inside the connecting duct 320. The evaporator 32 may configure the heat pump 30 together with the condenser 33, the compressor 31, and the expansion valve 34.

The heat pump 30 may cool hot air by circulating a refrigerant to remove moist from the air, and again heat the air. The evaporator 32 may remove moist from hot and humid air by cooling the air. Condensed water generated from air dehumidified by the evaporator 32 may be collected in a lower portion of the evaporator 32 and discharged to the outside.

The refrigerant of the heat pump 30 may receive heat from hot air in the evaporator 32, then be compressed by the compressor 31, and supplied to the condenser 33. The air dehumidified by the evaporator 32 may enter the condenser 33, be heated by the refrigerant, and then enter the drum 20.

Because heat exchange between air and a refrigerant occurs through the evaporator 32 and the condenser 33 of the heat pump 30 to form hot and dry air, the evaporator 32 and the condenser 33 are referred to as a heat exchanger.

The hot and dry air formed through the evaporator 32 and the condenser 33 may again enter the inside of the drum 20 through the blower 200 positioned inside the connecting duct 320. The blower 200 may be positioned between the connecting duct 320 and the hot air guide duct 330.

The connecting duct 320 may include a first connecting duct 321 installed on the base 15, and a second connecting duct 322 coupled with the first connecting duct 321. The evaporator 32 and the condenser 33 of the heat pump 30 may be positioned between the first connecting duct 321 and the second connecting duct 322.

One end of the connecting duct 320 may be connected with the hot air discharging duct 310, and the other end may be connected with the hot air guide duct 330. The connecting duct 320 may include the first connecting hole 320*a* formed to be connected with the hot air discharging duct 310, and the second connecting hole 320*b* formed to be connected with the hot air guide duct 330. The first connecting hole 320*a* and the second connecting hole 320*b* may be formed to correspond to the first connecting duct 321 and the second connecting duct 322, respectively, and the first connecting hole 320*a* may be connected with the second connecting hole 320*b* by coupling of the first connecting duct 321 with the second connecting duct 322.

The first connecting duct 321 may be formed to install the evaporator 32 and the condenser 33 therein. The first connecting duct 321 may be formed to install the blower 200 therein. An embodiment of the disclosure shows an example in which the first connecting duct 321 is formed separately from the base 15. However, a concept of the disclosure is not limited to this.

The second connecting duct 322 may be coupled with the first connecting duct 321 to cover the evaporator 32 and the condenser 33. The second connecting duct 322 may accommodate the blower 200 therein. The second connecting duct 322 may cover the blower 200.

Figure 8:
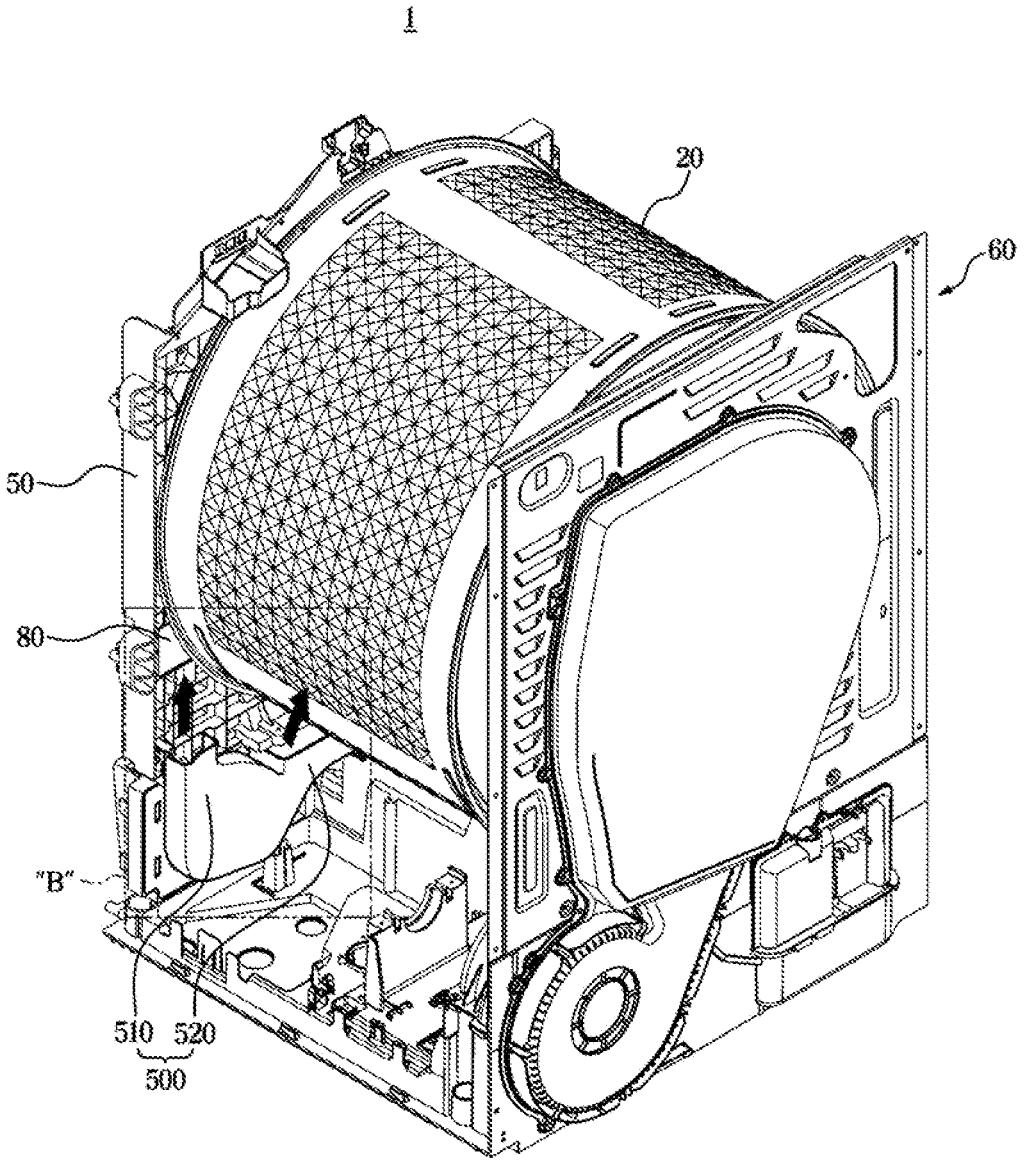
FIG. 8 is a perspective view showing one side of a clothes dryer according to an embodiment of the disclosure.
Figure 9:
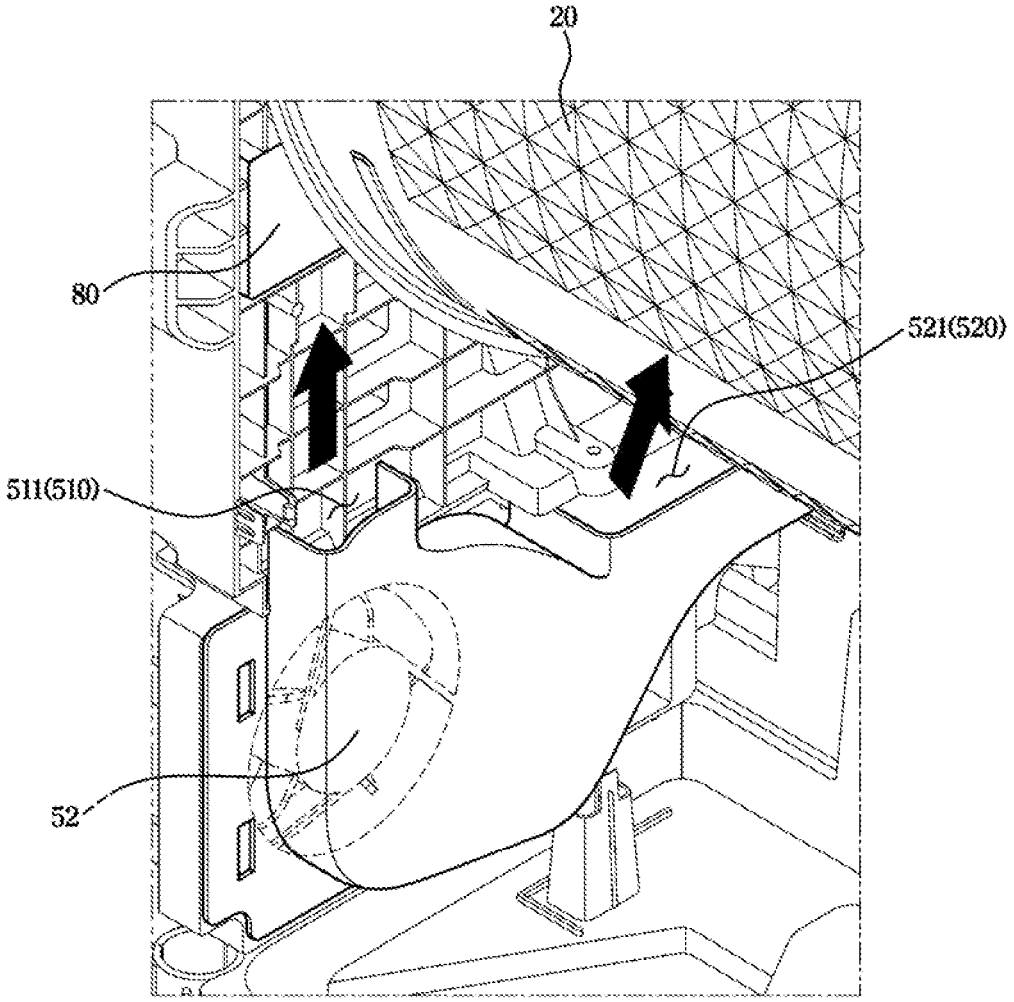
FIG. 9 is an enlarged view showing 'B' of FIG. 8 according to an embodiment of the disclosure.
Figure 10:
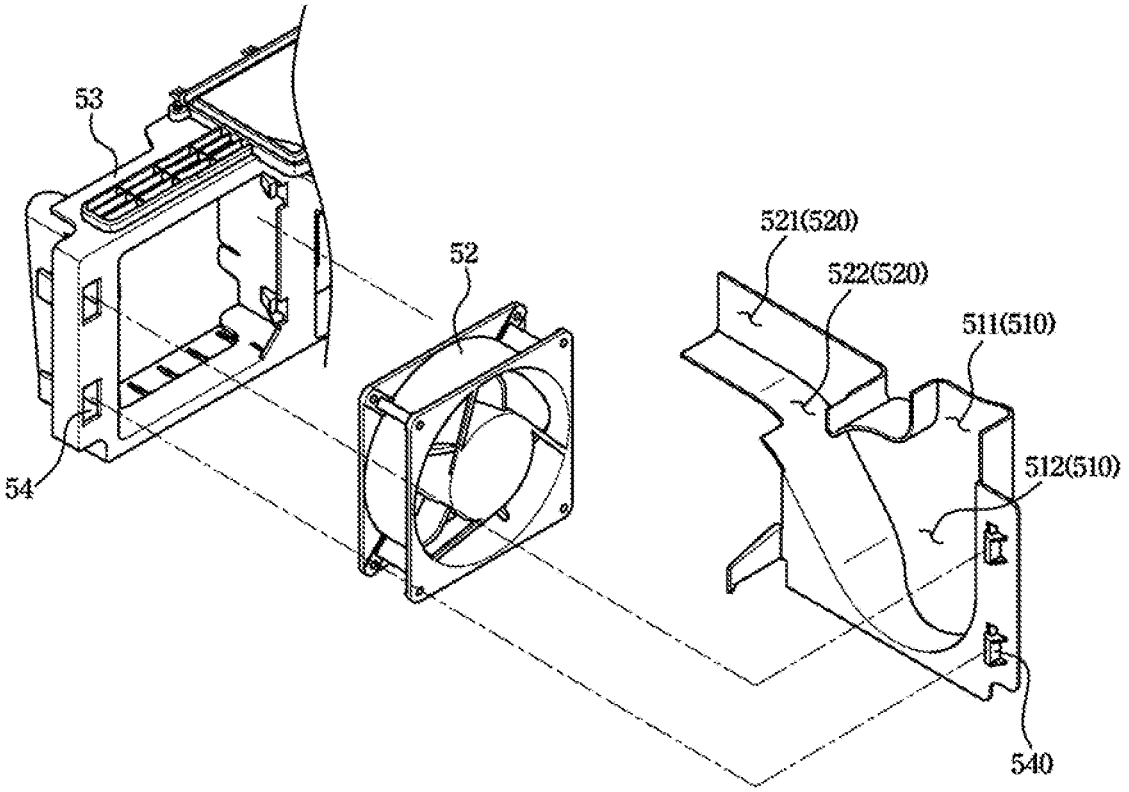
FIG. 10 is an exploded perspective view of a blow fan and a guide portion according to an embodiment of the disclosure.
Figure 11:
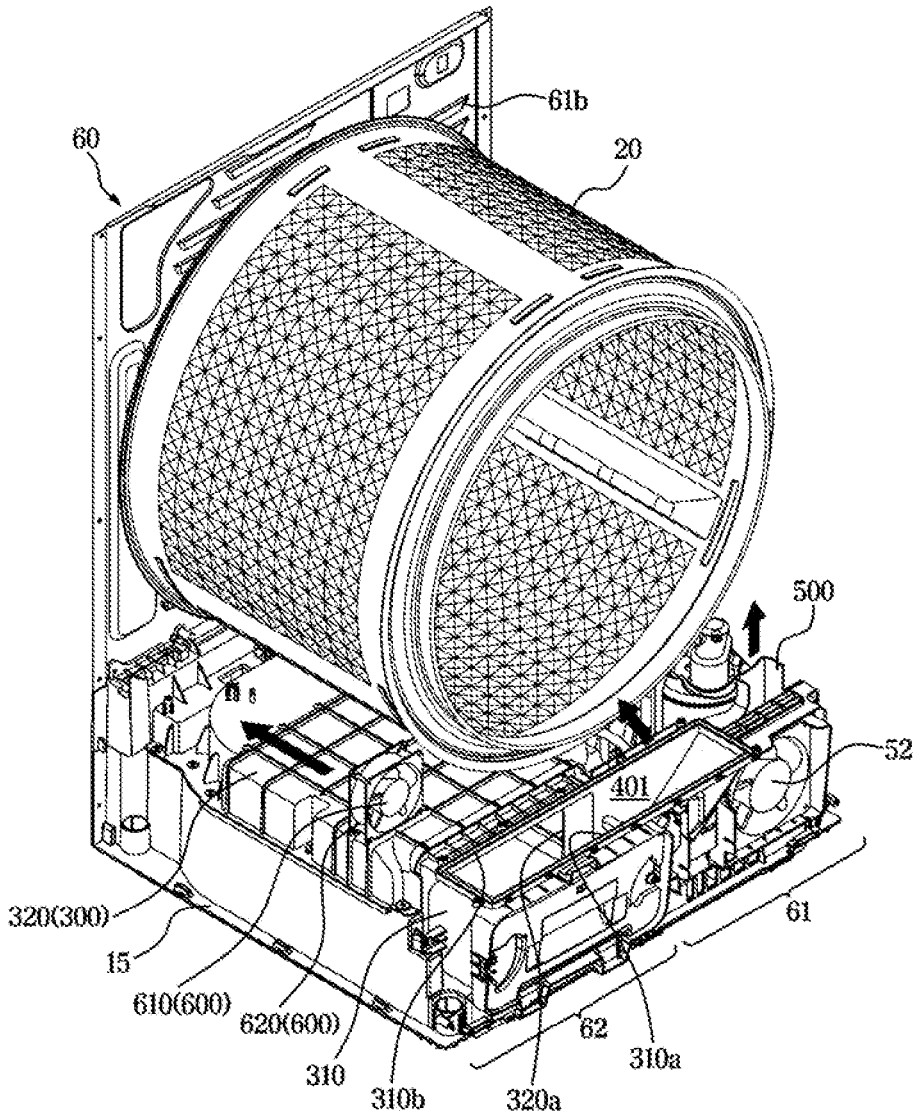
FIG. 11 is an internal perspective view showing the other side of a clothes dryer according to an embodiment of the disclosure.
Figure 12:
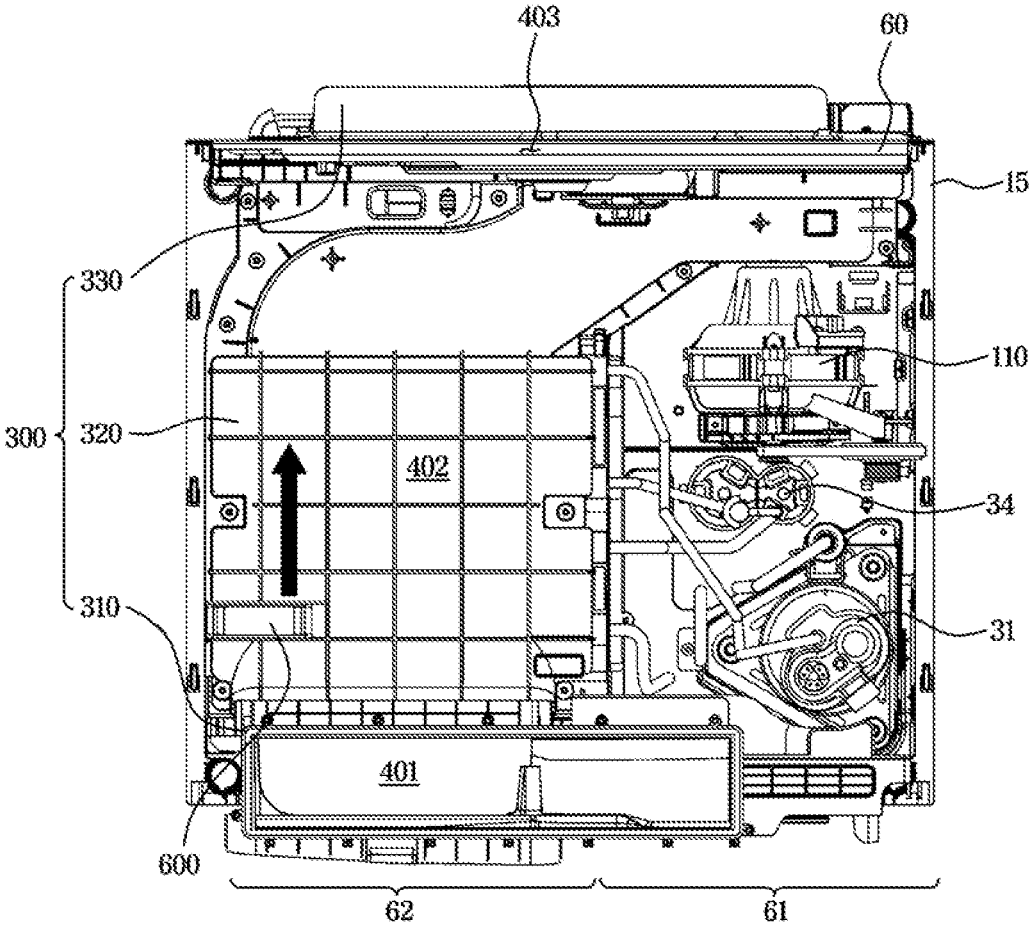
FIG. 12 is a top view showing a connecting duct and a forced convection device according to an embodiment of the disclosure.

FIG. 8 is a perspective view showing one side of a clothes dryer according to an embodiment of the disclosure, FIG. 9 is an enlarged view showing 'B' of FIG. 8, FIG. 10 is an exploded perspective view of a blow fan and a guide duct according to an embodiment of the disclosure, FIG. 11 is an internal perspective view showing the other side of a clothes dryer according to an embodiment of the disclosure, and FIG. 12 is a top view showing a connecting duct and a forced convection device according to an embodiment of the disclosure.

Referring to FIGS. 8 to 10, the clothes dryer 1 may further include the guide portion 500 connected with the blow fan 52 to dry air leaking out of the drum by using outside air entered the inside of the drum.

The guide portion 500 may be provided at a rear lower side of the front plate of the cabinet 10. The guide portion 500 may be provided below the front support frame 50.

The clothes dryer 1 may further include a Printed Board Assembly (PBA) 80 for driving various loads required for overall operations. The PBA 80 may be adjacent to the right plate 14*b* of the cabinet.

The guide portion 500 may provide outside air toward the PBA 80 to cool the PBA 80. For this, the guide portion 500 may be provided below the PBA 80 while being adjacent to the right plate 14*b* of the cabinet, although not limited thereto. However, the PBA 80 and the guide portion may be adjacent to the left plate 14*a* of the cabinet.

The guide portion 500 may lower temperature and humidity of moist air by mixing air leaking out of the drum with outside air of the cabinet 10. The guide portion 500 may disperse air leaking out of the drum 20 with the outside air.

The guide portion 500 may include a first guide portion 510 connected with the blow fan 52 to provide a part of outside air to the PBA 80, and a second guide portion 520 connected with the first guide portion 510 to provide the other part of the outside air toward the drum 20 and dry air leaking out of the drum 20. The first guide portion 510 and the second guide portion 520 may be integrated into one body.

The guide portion 500 may include the first guide portion 510 and the second guide portion 520 to cause outside air to flow in two directions such that the outside air is provided between the PBA 80 and the drum and the front support frame 50.

The first guide portion 510 may include a first outlet 511, and the second guide portion 520 may include a second outlet 521 such that outside air passed through the first outlet 511 cools the PBA 80 and outside air passed through the second outlet 521 dries air leaking out of the drum 20. The guide portion 500 may cool the PBA 80 while reducing relative humidity of air leaking out of the drum 20.

Upon entrance of outside air through the blow fan 52, the first guide portion 510 may move a part of the air toward the PBA 80 to cool the PBA 80, and the second guide portion 520 communicating with the first guide portion 510 may move the other part of the air toward the drum to dry air leaking out of the drum.

In this case, the second guide portion 520 may dry air leaking between the drum 20 and the front support frame 50. An end portion of the second guide portion 520 may extend toward between the drum 20 and the front support frame 50.

Air leaking between the front end portion 22*a* of the drum 20 and the sealing member installing portion 50*a* of the front support frame 50 may be effectively dried through the second guide portion 500 to be lowered in temperature and humidity, and accordingly, the air may be prevented from being condensed inside the cabinet.

Particularly, the guide portion 500 being adjacent to the right plate 14*b* of the cabinet 10 may efficiently dry air leaking to a right side of the drum 20. That is, because the guide portion 500 is adjacent to the first area 61 of the base 15, the guide portion 500 may efficiently dry air leaking to the first area 61 from the drum 20.

More specifically, as shown in FIG. 10, the blow fan 52 may be accommodated inside a blow fan case 53 provided below the front support frame 50, and the guide portion 500 may be coupled with the blow fan case 53 to perform a drying operation by using outside air entering by the blow fan 52.

In this case, a coupling hole 54 may be provided in one side of the blow fan case 53, and the guide portion 500 may include a coupling member 540 coupled with the coupling hole 54.

The first guide portion 510 may include a first passage 512 connected with the first outlet 511, and the second guide portion 520 may include a second passage 522 connected with the second outlet 521. A part of outside air entered by the blow fan 52 may be discharged to the first outlet 511 and supplied toward the PBA 80, and the other part of the outside air may pass through the second outlet 521 and be supplied toward the drum 20.

Meanwhile, referring to FIGS. 11 and 12, the clothes dryer 1 may further include a forced convection device 600 on an outer surface of the connecting duct 320 to forcedly convect air leaking out of the drum 20.

The forced convection device 600 may be adjacent to the left plate 14*a* of the cabinet 10 to forcedly convect air leaking to a left side of the drum 20, thereby preventing condensation on the left side of the drum 20 inside the cabinet 10. That is, the forced convection device 600 may be provided at an edge of the connecting duct 320 to circulate air leaking to the left side of the drum 20.

A right portion of the drum 20 may be effectively prevented from condensation by the guide portion 500 provided adjacent to the right plate 14*b* of the cabinet 10, and a left portion of the drum 20 may be effectively prevented from condensation by the forced convection device 600, although not limited thereto. However, the guide portion 500 and the forced convection device 600 may be provided on the same side with respect to the drum 20. Also, the guide portion 500 may be provided to the right side of the drum 20 and the forced convection device 600 may be provided to the left side of the drum 20.

As shown in FIG. 12, the forced convection device 600 may be provided in the second area 62 forming lower temperature than that of the first area 61 of the connecting duct 320. Because air leaking out of the drum is more condensed at relatively lower temperature, the forced convection device 600 may be provided in the second area 62 to effectively prevent condensation of air on the second area 62.

The forced convection device 600 may include a convection fan 610 for moving air by rotating, and a convection fan case 620 accommodating the convection fan 610 therein. The forced convection device 600 may be provided at an edge of the second area 62. The forced convection device 600 may be positioned in a direction from a front portion of the cabinet 10 toward a rear portion of the cabinet 10 to move air to the rear portion of the cabinet 10, that is, toward the rear support frame 60.

Meanwhile, as described above, the sealing member 70 may be provided between the front end portion 22*a* of the drum 20 and the sealing member installing portion 50*a* of the front support frame 50. Inside air of the drum 20 may leak to a gap (g1 and g2 of FIG. 3) between the drum 20 and the front support frame 50. That is, inside air of the drum 20 may leak between the sealing member 70 and the drum 20 (g1) or between the sealing member 70 and the front support frame 50 (g2). The forced convection device 600 may dissipate air leaking between the sealing member 70 and the front support frame 50 through forced convection, thereby preventing condensation generation by air leaking out of the drum 20 inside the cabinet 20. In this case, because the forced convection device 600 is located behind the sealing member 70, the forced convection device 600 may effectively prevent condensation of air leaking between the sealing member 70 and the front support frame.

The air dissipated by the forced convection device 600 may be discharged to the outside of the cabinet 10 through the plurality of holes 61*b* formed in the rear support frame 60.

The scope of rights of the disclosure is not limited to the above-described specific embodiments, and it is obvious that various other embodiments corrected or modified by those having ordinary skill in the technical field belong to the scope of rights of the disclosure without departing from the gist as the technical concept of the disclosure set forth in the claims.

What is claimed is:

1. A clothes dryer comprising:

a cabinet including an inlet and a base;

a drum rotatably provided inside the cabinet, the drum including a front end portion and a rear end portion;

a support frame including:

a front support frame supporting the front end portion of the drum, and having a laundry inlet, wherein the inlet of the cabinet, the laundry inlet, and the front end portion of the drum are positioned so that laundry is insertable through the inlet of the cabinet and then through the laundry inlet to be received in the drum, and a rear support frame supporting the rear end portion of the drum;

a blow fan below the front support frame; and a guide portion behind the blow fan, and connected with the blow fan, wherein the blow fan and the guide portion are configured so that:

the blow fan is operable to move outside air to inside of the cabinet, and the guide portion guides a first portion of the outside air moved inside of the cabinet by the blow fan toward a gap between the drum and the front support frame to dry air leaking from between the drum and the front support frame.

2. The clothes dryer of claim 1, further comprising:

a Printed Board Assembly (PBA) configured to drive various loads for overall operations of the clothes dryer, wherein the guide portion guides a second portion of the outside air moved inside of the cabinet by the blow fan to the PBA to cool the PBA.

3. The clothes dryer of claim 2, wherein the guide portion includes:

a first guide portion configured to guide the first portion of the outside air moved inside of the cabinet by the blow fan toward the gap between the drum and the front support frame, and a second guide portion connected with the first guide portion, and configured to guide the second portion of the outside air moved inside of the cabinet by the blow fan to the PBA.

4. The clothes dryer of claim 3, wherein the first guide portion and the second guide portion are integrated into one body.

5. The clothes dryer of claim 3, wherein the first guide portion extends toward the gap between the drum and the front support frame.

6. The clothes dryer of claim 3, wherein the first guide portion includes:

a first passage through which the first portion of the outside air moves, and a first outlet connected with the first passage and configured to discharge the first portion of the outside air, and the second guide portion includes:

a second passage through which the second portion of the outside air moves, and a second outlet connected with the second passage and configured to discharge the second portion of the outside air.

7. The clothes dryer of claim 1, further comprising:

a blow fan case below the front support frame and accommodating the blow fan, wherein the guide portion is coupled with the blow fan case.

8. The clothes dryer of claim 7, wherein a coupling hole is in one side of the blow fan case, and the guide portion includes a coupling member coupled with the coupling hole.

9. The clothes dryer of claim 1, further comprising:

a forced convection device on the base of the cabinet and configured to circulate air between the drum and the cabinet.

10. The clothes dryer of claim 9, wherein the forced convection device moves at least a portion of the air leaking from between the drum and the front support frame toward the rear support frame.

11. The clothes dryer of claim 9, further comprising:

a driver configured to transfer power to the drum;

a compressor;

an expansion valve;

an evaporator; and a condenser, wherein the base includes:

a first area on which the driver, the compressor, and the expansion valve are positioned, a second area on which the evaporator and the condenser are positioned, the second area forming a lower temperature than a temperature of the first area, and the forced convection device is provided on the second area.

12. The clothes dryer of claim 9, wherein the guide portion is adjacent to one of a left plate and a right plate of the cabinet, and the forced convection device is adjacent to a remaining one of the left plate and the right plate of the cabinet.

13. The clothes dryer of claim 9, wherein the forced convection device includes:

a convection fan configured to dissipate the air by rotating; and a convection fan case accommodating the convection fan.

14. The clothes dryer of claim 9, further comprising:

a duct connected with the drum and configured to circulate air through the drum, the duct including:

a hot air discharging duct connected to discharge air from inside of the drum, a connecting duct connected with the hot air discharging duct and accommodating an evaporator and a condenser to treat air passing through the connecting duct, and a hot air guide duct connected with the connecting duct and configured to supply air passed through the connecting duct to the drum, wherein the forced convection device is provided on an outer surface of the connecting duct.

15. The clothes dryer of claim 9, further comprising:

a sealing member coupled with a front surface of the drum and configured to form a seal between the drum and the front support frame, wherein the forced convection device is located behind the sealing member, and configured to circulate at least a portion of the air leaking from between the sealing member and the front support frame.

* * * * *